US012209803B2

(12) United States Patent
Gaskin et al.

(10) Patent No.: US 12,209,803 B2
(45) **Date of Patent: *Jan. 28, 2025**

(54) PRETREATMENT OF NATURAL GAS PRIOR TO LIQUEFACTION

(71) Applicant: Lummus Technology Inc., Bloomfield, NJ (US)

(72) Inventors: Thomas K. Gaskin, Spring, TX (US); Fereidoun Yamin, Houston, TX (US); Galip H. Guvelioglu, The Woodlands, TX (US); Vanessa M. Palacios, Houston, TX (US)

(73) Assignee: Lummus Technology Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/878,374

(22) Filed: Aug. 1, 2022

(65) Prior Publication Data

US 2022/0373257 A1 Nov. 24, 2022

Related U.S. Application Data

(63) Continuation of application No. 15/257,100, filed on Sep. 6, 2016, now Pat. No. 11,402,155.

(51) Int. Cl.
*F25J 3/02* (2006.01)
*F25J 3/08* (2006.01)

(52) U.S. Cl.
CPC ..... *F25J 3/08* (2013.01); *F25J 3/0209* (2013.01); *F25J 3/0233* (2013.01); *F25J 3/0238* (2013.01);
(Continued)

(58) Field of Classification Search
CPC ..... F25J 3/0209; F25J 3/0233; F25J 3/0238; F25J 3/0242; F25J 3/0247; F25J 2205/04;
(Continued)

(56) References Cited

U.S. PATENT DOCUMENTS 3,542,673 A 11/1970 Ringler
3,568,458 A 3/1971 Hoffman
(Continued)

FOREIGN PATENT DOCUMENTS

CN 101072848 A 11/2007
CN 101290184 A 10/2008
(Continued)

OTHER PUBLICATIONS

Written Opinion of the International Searching Authority, dated May 26, 2015, in related PCT application PCT/US2015/020360.
(Continued)

*Primary Examiner* — Brian M King
(74) *Attorney, Agent, or Firm* — Calfee, Halter & Griswold LLP

(57) ABSTRACT

Method and system for removing high freeze point components from natural gas. Feed gas is cooled in a heat exchanger and separated into a first vapor portion and a first liquid portion. The first liquid portion is reheated using the heat exchanger and separated into a high freeze point components stream and a non-freezing components stream. A portion of the non-freezing components stream may be at least partially liquefied and received by an absorber tower. The first vapor portion may be cooled and received by the absorber tower. An overhead vapor product which is substantially free of high freeze point freeze components and a bottoms product liquid stream including freeze components and non-freeze components are produced using the absorber tower.

20 Claims, 8 Drawing Sheets

(52) U.S. Cl.
CPC ..... *F25J 3/0242* (2013.01); *F25J 3/0247* (2013.01); *F25J 3/0295* (2013.01); *F25J 2200/04* (2013.01); *F25J 2200/76* (2013.01); *F25J 2200/78* (2013.01); *F25J 2205/04* (2013.01); *F25J 2205/50* (2013.01); *F25J 2210/04* (2013.01); *F25J 2210/60* (2013.01); *F25J 2215/02* (2013.01); *F25J 2215/04* (2013.01); *F25J 2220/60* (2013.01); *F25J 2220/64* (2013.01); *F25J 2230/32* (2013.01); *F25J 2230/60* (2013.01); *F25J 2240/02* (2013.01); *F25J 2240/40* (2013.01); *F25J 2245/02* (2013.01); *F25J 2260/20* (2013.01); *F25J 2280/10* (2013.01); *F25J 2290/12* (2013.01)

(58) Field of Classification Search
CPC .. F25J 2215/04; F25J 2215/66; F25J 2220/64; F25J 2210/04
See application file for complete search history.

(56) References Cited

U.S. PATENT DOCUMENTS

| | | | | |
|---|---|---|---|---|
| 3,622,504 | A | 11/1971 | Strum | |
| 3,656,311 | A | 4/1972 | Kaiser | |
| 3,815,376 | A | 6/1974 | Lofredo et al. | |
| 4,019,964 | A | 4/1977 | Fickel | |
| 4,272,270 | A | 6/1981 | Higgins | |
| 4,436,540 | A * | 3/1984 | Dowd | F25J 3/0238 62/935 |
| 4,689,063 | A | 8/1987 | Paradowski et al. | |
| 4,698,081 | A | 10/1987 | Aghili | |
| 4,854,955 | A | 8/1989 | Campbell et al. | |
| 5,325,673 | A | 7/1994 | Durr et al. | |
| 5,685,170 | A | 11/1997 | Sorensen | |
| 5,724,833 | A | 3/1998 | Devers | |
| 5,737,940 | A | 4/1998 | Yao et al. | |
| 5,799,507 | A | 9/1998 | Wilkinson et al. | |
| 5,881,569 | A * | 3/1999 | Campbell | F25J 3/0209 62/621 |
| 5,890,378 | A | 4/1999 | Rambo et al. | |
| 6,116,050 | A | 9/2000 | Yao et al. | |
| 6,401,486 | B1 | 6/2002 | Lee et al. | |
| 6,425,266 | B1 | 7/2002 | Roberts | |
| 6,662,589 | B1 | 12/2003 | Roberts et al. | |
| 6,837,070 | B2 | 1/2005 | Mak | |
| 7,051,553 | B2 | 5/2006 | Mak et al. | |
| 7,210,311 | B2 | 5/2007 | Wilkinson et al. | |
| 7,219,513 | B1 | 5/2007 | Mostafa | |
| 7,237,407 | B2 | 7/2007 | Paradowski | |
| 8,209,997 | B2 | 7/2012 | Malsam | |
| 8,413,463 | B2 | 4/2013 | Malsam | |
| 8,627,681 | B2 | 1/2014 | Malsam | |
| 9,291,387 | B2 | 3/2016 | Malsam | |
| 9,316,433 | B2 | 4/2016 | Mak | |
| 2002/0112993 | A1 | 8/2002 | Puglisi | |
| 2003/0106334 | A1 | 6/2003 | Gaskin | |
| 2004/0159122 | A1 | 8/2004 | Patel et al. | |
| 2004/0244415 | A1 | 12/2004 | Paradowski | |
| 2005/0086976 | A1 | 4/2005 | Eaton | |
| 2006/0144081 | A1 * | 7/2006 | Paradowski | F25J 3/0242 62/620 |
| 2006/0150672 | A1 | 7/2006 | Lee et al. | |
| 2006/0260355 | A1 | 11/2006 | Roberts et al. | |
| 2007/0157663 | A1 | 7/2007 | Mak et al. | |
| 2007/0240450 | A1 | 10/2007 | Mak | |
| 2008/0000216 | A1 | 1/2008 | Fujimura et al. | |
| 2008/0000265 | A1 | 1/2008 | Cuellar et al. | |
| 2008/0115532 | A1 | 5/2008 | Jager | |
| 2008/0271480 | A1 * | 11/2008 | Mak | F25J 1/0255 62/626 |
| 2010/0011663 | A1 | 1/2010 | Coyle | |
| 2010/0223950 | A1 | 9/2010 | Malsam | |
| 2010/0263532 | A1 * | 10/2010 | Thomas | C10G 5/02 95/117 |
| 2011/0067441 | A1 | 3/2011 | Martinez et al. | |
| 2012/0047943 | A1 | 3/2012 | Barclay et al. | |
| 2014/0075987 | A1 * | 3/2014 | Mak | F25J 3/0238 62/630 |
| 2014/0260420 | A1 | 9/2014 | Mak | |
| 2016/0069610 | A1 * | 3/2016 | Anguiano | F25J 3/0238 62/621 |
| 2016/0245587 | A1 * | 8/2016 | Shah | F25J 3/0233 |

FOREIGN PATENT DOCUMENTS

| | | | |
|---|---|---|---|
| CN | 101824344 | A | 9/2010 |
| CN | 102027303 | A | 4/2011 |
| GB | 800888 | A | 9/1958 |
| JP | S56-124401 | A | 9/1981 |
| JP | 2005042093 | A | 2/2005 |
| JP | 2006510867 | A | 3/2006 |
| JP | 2008523186 | A | 7/2008 |
| JP | 2009174849 | A | 8/2009 |
| JP | 2010202875 | A | 9/2010 |
| JP | 2011521052 | A | 7/2011 |
| JP | 2013505421 | A | 2/2013 |
| JP | 2015531851 | A | 11/2015 |
| KR | 1020120069729 | A | 6/2012 |
| KR | 1020150102931 | A | 9/2015 |
| WO | 8002192 | A1 | 10/1980 |
| WO | 9736139 | A1 | 10/1997 |
| WO | 0188447 | A1 | 11/2001 |
| WO | 02061354 | A1 | 8/2002 |
| WO | 2004057253 | A2 | 7/2004 |
| WO | 2009140070 | A1 | 11/2009 |
| WO | 2012052411 | A1 | 4/2012 |
| WO | 2014022510 | A2 | 2/2014 |
| WO | 2015138846 | A1 | 9/2015 |

OTHER PUBLICATIONS

International Search Report and Written Opinion of the International Searching Authority from corresponding International Application No. PCT/US2017/026464 dated Jul. 11, 2017.
Examination Report No. 1 for AU Patent Application No. 2017324000 dated May 11, 2021.
First Office Action for Chinese Patent Application No. CN201780067756.X, dated Sep. 30, 2020.
Second Office Action for Chinese Patent Application No. CN201780067756.X, dated Apr. 27, 2021.
Third Office Action for Chinese Patent Application No. CN201780067756.X, dated Nov. 25, 2021.
Decision of Rejection for Chinese Patent Application No. CN201780067756.X, dated Mar. 31, 2022.
Extendend European Search Report for European Patent Application No. EP17849229.4, dated Apr. 24, 2020.
Japanese Office Action for Japanese Patent Application No. JP2019-512766, dated Jan. 28, 2021.
First Office Action for Korean Patent Application No. KR10-2019-7009610, dated Jul. 17, 2020.
First Examination Report for Saudi Arabian Patent Application No. SA519401248, dated Oct. 24, 2021.
Office Action from U.S. Appl. No. 15/257,100 dated Mar. 29, 2019.
Office Action from U.S. Appl. No. 15/257,100 dated Aug. 2, 2019.
Office Action from U.S. Appl. No. 15/257,100 dated Dec. 6, 2019.
Office Action from U.S. Appl. No. 15/257,100 dated Apr. 17, 2020.
Office Action from U.S. Appl. No. 15/257,100 dated Nov. 3, 2020.
Office Action from U.S. Appl. No. 15/257,100 dated May 5, 2021.
Notice of Allowance from U.S. Appl. No. 15/257,100 dated Dec. 14, 2021.
Huang S. et al., "Handling LPG Components in LNG Plants", 2011 Aiche Spring Meeting & 7th Global Congress on Process Safety; Hyatt Regency Chicago, Chicago, IL, Mar. 13-17, 2011, New York; American Institute of Chemical Engineers, US, (Mar. 1, 2011), ISBN 978-0-8169-1067-0.

(56) References Cited

OTHER PUBLICATIONS

Production of Benzene, Toluene, and Xylenes from Natural Gas via Methanol: Process Synthesis and Global Optimization: DOI 10.1002/aic.15144; Published online Jan. 13, 2016 in Wiley Online Library (wileyonlinelibrary.com).
"Gas Worker", Labor Management Bureau of China National Petroleum Corporation, Petroleum Industry Press, published in Feb. 2001, 4th printing, pp. 182-184.
Office Action from CA Application No. 3,035,873 dated Dec. 13, 2022.
Search and Examination Reports from UAE Application No. P6000338/19 dated May 4, 2023.
Examination Report from BH Application No. 20190063 dated May 24, 2023.
Office Action from CA Application No. 3,035,873 dated Jul. 18, 2023.
Office Action from PE Application No. 480-2019/DIN dated Oct. 3, 2023.
Extended European Search Report issued in European Patent Application No. 23215105.0 dated May 10, 2024.
Office Action from MX Application No. MX/a/2019/002550 dated Sep. 5, 2024.

* cited by examiner

PRETREATMENT OF NATURAL GAS PRIOR TO LIQUEFACTION

CROSS-REFERENCE TO RELATED APPLICATIONS

This application is a continuation of U.S. application Ser. No. 15/257,100, filed on Sep. 6, 2016, the entire disclosure of which is incorporated herein by reference.

FIELD OF THE INVENTION

The present disclosure is directed to systems, methods and processes for the pretreatment of natural gas streams prior to liquefaction and more particularly to, the removal of heavy or high freeze point hydrocarbons from a natural gas stream.

BACKGROUND

It is generally desirable to remove components such as acid gases (for example, $H_2S$ and $CO_2$), water and heavy or high freeze point hydrocarbons from a natural gas stream prior to liquefying the natural gas, as those components may freeze in the liquefied natural gas (LNG) stream. High freeze point hydrocarbons include all components equal to or heavier than i-pentane (C5+), and aromatics, in particular benzene, which has a very high freeze point.

Sources for natural gas to be liquefied may include gas from a pipeline or from a specific field. Transportation of gas in pipelines is often accomplished at pressure between 800 psia and 1200 psia. As such, pretreatment methods should preferably be able to operate well with 800 psia or higher inlet pressures.

An exemplary specification for feed gas to a liquefaction plant contains less than 1 parts per million by volume (ppmv) benzene, and less than 0.05% molar pentane and heavier (C5+) components. High freeze point hydrocarbon component removal facilities are typically located downstream of pretreatment facilities which remove mercury, acid gases and water.

A simple and common system for pretreatment of LNG feed gas for removal of high freeze point hydrocarbons involves use of an inlet gas cooler, a first separator for removal of condensed liquids, an expander (or Joule-Thompson (JT) valve or refrigeration apparatus) to further cool the vapor from the first separator, a second separator for removal of additional condensed liquid, and a reheater for heating the cold vapor from the second separator. The reheater and the inlet gas cooler would typically constitute a single heat exchanger. The liquid streams from the first and second separators would contain the benzene and C5+ components of the feed gas, along with a portion of lighter hydrocarbons in the feed gas which have also condensed. These liquid streams may be reheated by heat exchange with the inlet gas. These liquid streams may also be further separated to concentrate the high freeze point components from components that may be routed to the LNG plant without freezing.

In cases in which a feed gas to an existing LNG plant changes to contain more benzene than was anticipated, the high freeze point hydrocarbon removal plant will not be able to meet the required benzene removal to avoid freezing in the liquefaction plant. Additionally, specific locations in the high freeze point component removal plant may freeze due to the increase in benzene. The LNG facility may have to reduce production by no longer accepting a source of gas with higher benzene concentration, or cease production entirely if the benzene concentration cannot be reduced.

Moreover, while feed gas pressure may change over time, there is a limit of how high the lowest system pressure can be in existing methods of removing heavy hydrocarbons. Above this pressure, the physical properties of the vapor and liquid do not allow effective separation. Conventional systems have to lower the pressure more than required simply to meet these physical property requirements, and there is a sacrifice in energy efficiency associated with such lowering of pressure.

There is a need in the art for systems and methods that provide for improved removal of high freeze point hydrocarbons from natural gas streams. There is also a need in the art for greater efficiency in the removal of high freeze point hydrocarbons from natural gas streams. The present disclosure provides solutions for these needs.

SUMMARY

A method for removing high freeze point components from natural gas includes cooling a feed gas in a heat exchanger. The feed gas is separated into a first vapor portion and a first liquid portion in a separation vessel. The first liquid portion is reheated using the heat exchanger. The first liquid portion may be reduced in pressure prior to entering the heat exchanger, after leaving the heat exchanger, or both. The reheated first liquid portion can be provided to a distillation column, distillation tower, or debutanizer. The reheated first liquid portion is separated into a high freeze point components stream and a non-freezing components stream. A portion of the non-freezing components stream is at least partially liquefied. In some embodiments, partial liquefaction can be achieved by cooling with the heat exchanger and reducing pressure. In some embodiments, the non-freezing components stream is increased in pressure (for example, through use of a compressor) prior to such cooling and pressure reduction. The cooled and pressure reduced non-freezing components stream is received by an absorber tower. The absorber tower can include one or more mass transfer stages. The first vapor portion of the separated feed gas may be cooled and reduced in pressure and received by the absorber tower. An overhead vapor product which is substantially free of high freeze point freeze components and a bottoms product liquid stream including freeze components and non-freeze components are produced using the absorber tower. The overhead vapor product from the absorber tower may be reheated using the heat exchanger. The bottoms product liquid stream from the absorber tower can be pressurized and reheated and at least a portion of the reheated bottoms product liquid stream may be mixed with the feed gas prior to entry into the heat exchanger. The method can further include compressing the reheated overhead vapor product using an expander-compressor to produce a compressed gas stream. The compressed gas stream can be further compressed to produce a higher pressure residue gas stream. The higher pressure residue gas stream can be sent to a natural gas liquefaction facility.

In some embodiments, the overhead stream from the distillation column, distillation tower, or debutanizer can be increased in pressure (for example, through use of a compressor). A portion of the compressed overhead stream can, in some embodiments, be mixed with a portion of the high pressure residue gas stream, and the resulting combined stream cooled in the heat exchanger and used as an overhead feed to the absorber tower. The stream received at the upper feed point of the absorber tower can, in some embodiments, be introduced as a spray.

In some embodiments, a portion of the non-freezing components stream from the distillation tower, distillation column, or debutanizer can be increased in pressure and routed through the heat exchanger, wherein the non-freezing components stream is partially liquefied using the reheated overhead vapor product for cooling, and the cooled portion of the non-freezing components stream can be routed to a side inlet of the absorber tower.

A portion of the higher pressure residue gas stream can be cooled in the heat exchanger, reduced in pressure, and routed as the overhead feed of the absorber tower. A portion of the bottoms product liquid stream from the absorber tower can be routed to one or more additional towers, the one or more additional towers including a demethanizer, deethanizer, a depropanizer and a debutanizer.

The absorber tower operating pressure can be from about 300 psia to about 850 psia. For example, above one of 400 psia, 600 psia, 700 psia, and 800 psia. As another example, from 400-750 psia, from 500-700 psia, and from 600-700 psia. As yet another example, from 600-625 psia, from 625-650 psia, from 650-675 psia, and from 675-700 psia. The absorber tower operating pressure can be within about 100-400 psia less than an inlet gas pressure. For example, 200-300 psia less than inlet gas pressure. As another example, 200-225 psia, 225-250 psia, 250-275 psia, and 275-300 psia less than inlet gas pressure.

A system for removing high freeze point components from natural gas includes a heat exchanger for cooling feed gas; a separation vessel for separating the feed gas into a first vapor portion and a first liquid portion, wherein the first liquid portion is reheated in the heat exchanger; a second separation vessel for separating the reheated first liquid portion into a high freeze point components stream and a non-freezing components stream; and an absorber tower for receiving a cooled and pressure reduced non-freezing components stream and receiving a cooled and pressure reduced first vapor portion. An overhead vapor product from the absorber tower may be reheated with the heat exchanger, the overhead vapor product being substantially free of high freeze point components. A bottoms product liquid stream from the absorber tower includes high freeze point components and non-freezing components. In some embodiments, the bottom product liquid stream from the absorber tower may be pressurized and reheated, and at least a portion of the reheated bottoms product liquid stream may be mixed with the feed gas prior to entry into the heat exchanger.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures.

Figure 1:
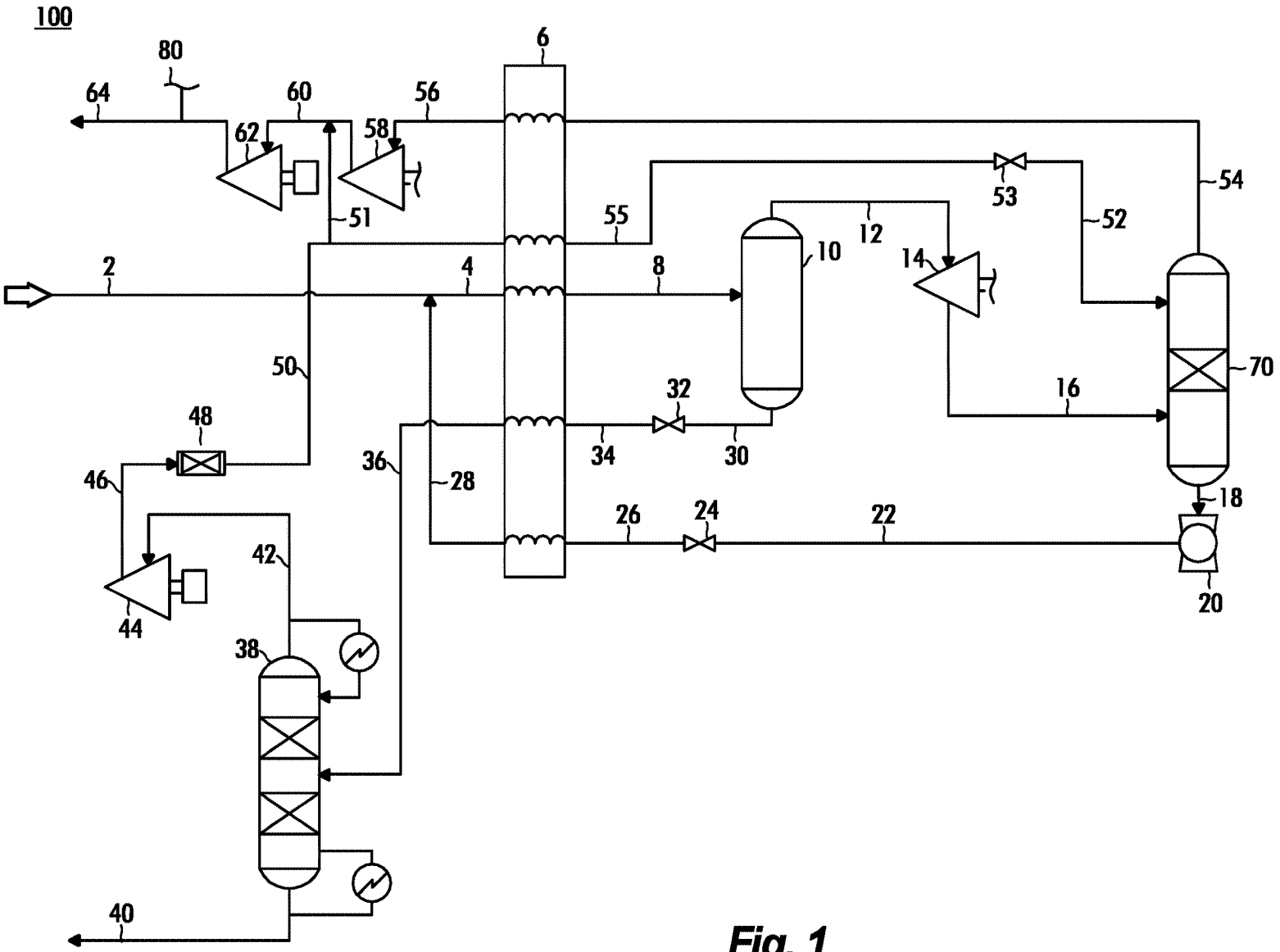
FIG. 1 is a schematic view of an exemplary system and process for removing high freeze point hydrocarbons from a mixed hydrocarbon gas stream according to an embodiment herein.

These and other aspects of the subject disclosure will become more readily apparent to those having ordinary skill in the art from the following detailed description of the invention taken in conjunction with the drawings.

DETAILED DESCRIPTION

Reference will now be made to the drawings wherein like reference numerals identify similar structural features or aspects of the subject disclosure.

New cryogenic processes are described herein to extract freezing components (heavy hydrocarbons, including but not necessarily limited to benzene, toluene, ethylbenzene and xylene (BTEX) and cyclohexane) from a pretreated natural gas stream prior to liquefaction.

Raw feed gas is first treated to remove freezing components such as $CO_2$, water and heavy hydrocarbons before liquefaction. Removal of $CO_2$ and water is achieved by several commercially available processes. However, removal of freezing hydrocarbon components by cryogenic process depends on the type and amount of components to be removed. For feed gases that are low in components such as C2, C3, C4s, but contain hydrocarbons that will freeze during liquefaction, separation of the freezing components is more difficult.

Definitions: as used herein, the term "high freeze point hydrocarbons" refers to cyclohexane, benzene, toluene, ethylbenzene, xylene, and other compounds, including most hydrocarbons with at least five carbon atoms. As used herein, the term "benzene compounds" refers to benzene, and also to toluene, ethylbenzene, xylene, and/or other substituted benzene compounds. As used herein, the term "methane-rich gas stream" refers to a gas stream with greater than 50 volume % methane. As used herein, the term "pressure increasing device" refers to a component that increases the pressure of a gas or liquid stream, including a compressor and/or a pump. As used herein, "C4" refers to butane and lighter components such as propane, ethane and methane.

TABLE 1

| Properties of heavier hydrocarbons (e.g., freeze point of select hydrocarbons) | | | |
|---|---|---|---|
| Component | Boiling point at 14.7 psia, ° F. | Vapor pressure at 100° F., psia | Freezing point at 14.4 psia, ° F. |
| Propane | −44 | 118 | −305 |
| N-Butane | 31 | 51 | −217 |
| N-Pentane | 97 | 16 | −201 |
| N-Hexane | 156 | 5 | −140 |
| N-Heptane | 206 | 2 | −131 |
| N-Octane | 258 | 1 | −70 |
| Benzene | 176 | 3 | 42 |
| P-Xylene | 281 | 0.3 | 56 |
| O-Xylene | 292 | 0.3 | −13 |

Referring to Table 1, which shows properties (e.g., freeze point) of some heavier hydrocarbons that could be in a feed stream, benzene has a boiling point and vapor pressure similar to n-hexane and n-heptane. However, the freeze point of benzene is about 175° F. higher. N-octane, P-xylene, and O-xylene, among others, also have physical properties that lead to freezing at temperatures above where other components common in natural gas would not have substantially condensed as liquid.

In embodiments, the processes described herein typically have mixed hydrocarbon feed streams with a high freeze point hydrocarbon content in the range of 100 to 20,000 ppm molar C5+, or 10 to 500 ppm molar benzene, a methane content in the range of 80 to 98% molar, or 90 to 98% molar. The methane-rich product stream typically has a high freeze point hydrocarbon content in the range of 0 to 500 ppm molar C5+, or 0 to 1 ppm molar benzene, and a methane content in the range of 85 to 98% molar, or 95 to 98% molar.

In embodiments, the processes described herein may utilize temperatures and pressures in the range of −90 to 50 F and 500 to 1200 psia in the first separation vessel; alternatively, −90 to 10 F and 500 to 1000 psia. For example, −65 to 10 F and 800 to 1000 psia. In embodiments, the processes described herein may utilize temperatures and pressures in the range of −170 to −10 F and 400 to 810 psia in the second separation vessel, e.g., an absorber tower or a distillation column. For example, −150 to −80 F and 600 to 800 psia.

A typical specification for inlet gas to a liquefaction plant is <1 ppm molar benzene and <500 ppm molar pentane and heavier components. Tables 3 and 6 illustrate compositions of typical feed gas streams that may need pretreatment prior to liquefaction. Separation of the freezing components is difficult because during the cooling process, there isn't a sufficient amount of C2, C3 or C4 in the liquid stream to dilute the concentration of freezing components and keep them from freezing. This problem is greatly magnified during the startup of the process when the first components to condense from the gas are heavy ends, without the presence of any C2 to C4 components. In order to overcome this problem, processes and systems have been developed that will eliminate freezing problems during startup and normal operation.

For purposes of explanation and illustration, and not limitation, a partial view of an exemplary embodiment of a method, process and system for heavy hydrocarbon removal in accordance with the disclosure is shown in FIG. 1 and is designated generally by reference character 100. Other embodiments of the system and method in accordance with the disclosure, or aspects thereof, are provided in FIGS. 2-8, as will be described. Systems and methods described herein can be used for removing heavy hydrocarbons from natural gas streams, for example, for removing benzene from a lean natural gas stream.

As previously stated, pretreatment of natural gas prior to liquefaction is generally desired in order to prevent freezing of high freeze point hydrocarbons in natural gas liquefaction plants. Of the high freeze point hydrocarbon components to be removed, benzene is often most difficult to remove. Benzene has a very high condensation temperature and high freeze point temperature. A typical liquefaction hydrocarbon inlet gas purity specification is less than 1 parts per million by volume (ppmv) of benzene, and less than 0.05% concentration of all combined pentane and heavier components.

Furthermore, gas liquefaction plants are typically designed for operation with an inlet pressure of 800 psia or higher. Pretreatment plants often operate with 800 psia or higher inlet, with 800 psia or higher outlet to liquefaction. This makes use of the available gas pressure. A liquefaction plant may also be able to operate with a lower inlet gas pressure, but with a lower capacity and efficiency. However, making the best use of the energy in the range of 600 psia-900 psia inlet pressure presents challenges.

Moreover, the gas composition used as the base case presents additional challenges as the benzene concentration is high (500 ppm or more) and the gas is lean with approximately 97% methane. As such, there are very few heavier hydrocarbons that can condense to dilute condensing benzene, thereby increasing the likelihood of benzene freeze.

Generally, it is desirable to operate at as high of a pressure as possible so as to reduce gas recompression requirements. Minimizing pressure drop is also desired in order to reduce recompression capital and operating costs. Operation at close to the inlet high pressure operation limits the amount of energy extracted by the expander (or pressure reduction valve). However, higher operating pressures combined with cold operating temperatures can result in operation closer to critical conditions for the hydrocarbons; density difference between vapor and liquid that are smaller than operation at lower pressure; lower liquid surface tension; and smaller differences in relative volatility of the components.

Conventional systems and processes involve multiple steps of cooling and separation to avoid freezing of benzene, along with operation at low pressure for final separation, even when inlet pressure was high. Moreover, these systems are complex and require significant power consumption for recompression.

Embodiments herein provide for a simplified plant that can process gas containing high concentration and high quantities of benzene. Furthermore, embodiments herein process high benzene content gas with high inlet pressure, minimize recompression power requirements by minimizing the pressure drop required to allow the system to perform, without freezing the benzene or other freeze components contained in the inlet gas, and maintain physical properties such as density and surface tension in a high pressure system that will allow for reliable separation operations.

Embodiments herein also provide systems and processes that allow for an inlet gas pressure above 600 psia (e.g., 900 psia) at the inlet of the high freeze-point removal process. Delivery pressure from the process can also be at a high pressure, (e.g., 900 psia). The gas pressure can be reduced during the freeze component removal process. Minimizing pressure reduction is advantageous, as less recompression capital and operating cost is needed. Furthermore, embodiments herein minimize equipment count and cost to achieve the required separation without producing waste products such a fuel gas streams. Only two products are created in various embodiments herein: feed gas to the liquefaction plant; and low vapor pressure C5+ with benzene liquid product. Moreover, embodiments herein provide a process that works without freezing.

Referring to the figures, FIG. 1 shows a schematic view of an exemplary system 100 for removing high freeze point hydrocarbons from a mixed hydrocarbon gas stream, according to an embodiment herein. As shown, feed gas stream 2 containing benzene (e.g., 40 mols/hr, or 500 ppmv) is provided to system 100, mixed with stream 28, becoming stream 4 and is provided to exchanger 6 where it is cooled, forming a partially condensed stream 8, which enters cold separator 10. Stream 12, which is the vapor from cold separator 10, enters a pressure reduction device 14 (e.g., an expander or JT valve), which reduces the pressure and temperature and extracts energy from the stream 12. The reduced temperature stream 16 which exits the pressure reduction device 14 has been partially condensed, and is routed to a tower (e.g., absorber tower) 70. Tower 70 includes internals for one or more mass transfer stages (e.g., trays and/or packing). Heat and mass transfer occurs in tower 70 as vapor from stream 16 rises and contacts falling liquid from stream 52 which is substantially free of C5+ and absorbs the benzene. Vapor stream 54 from tower 70 is reheated in exchanger 6 to provide cooling of stream 4, and exits as stream 56. Stream 56 is provided to expander-compressor 58, wherein the pressure is increased, exiting as stream 60. Stream 60 is directed to residue compressor 62 and exits as stream 64. In certain embodiments, stream 64 is fed to a LNG liquefaction facility. In certain embodiments, as will be discussed in more detail below, a portion of stream 64 may split off as stream 80 for further processing or use. Stream 64 meets specifications for benzene and for C5+ hydrocarbons entering the liquefaction plant. Typical liquefaction plant specifications are 1 ppmv benzene or less, and 0.05% molar C5+ or less.

Liquid stream 18 originating from the bottom of the tower 70 is increased in pressure in pump 20, exiting as stream 22. This stream 22 passes through level control valve 24 and exits as stream 26. This partially vaporized and auto-refrigerated stream 26 is reheated in exchanger 6, exits as stream 28, mixed with the feed gas 2, and is cooled again as part of the mixed feed gas stream 4. These exchanger routings are necessary as stream 2 would freeze without addition of the recycle liquid stream 4 as it is cooled. Reheat of the stream exiting from the absorber tower bottom is required for the energy balance.

Cold recycle stream originating as liquid stream 30 from the cold separator 10 is reduced in pressure across level control valve 32, exiting as stream 34. This partially vaporized and auto-refrigerating stream 34 is reheated by exchange against the feed gas stream 2 in exchanger 6, leaving as stream 36. In certain embodiments, the liquid stream 30 may be reduced in pressure before heat exchange, after heat exchange or both. This stream 36 is separated in a debutanizer 38, or in a distillation column, a distillation tower, or any suitable component separation method. A portion exits as stream 40, which contains the removed high freeze point hydrocarbons (e.g., benzene and other C5+ components). A portion of the debutanized stream exits debutanizer 38 as debutanizer overhead stream 47 and passes through a compressor 44 and a cooler 48 as compressed debutanizer overhead product stream 50. A portion of the compressed debutanizer overhead product stream 50 is cooled in exchanger 6 prior to entering absorber tower 70. The reheat and recool routing for this loop is also necessary for the energy balance.

The compressed debutanizer overhead stream 50 meets purity required for it to be routed to the product gas to liquefaction. However, a portion of the compressed debutanizer overhead stream 50 must be routed to the overhead of the absorber tower 70. This portion of the compressed debutanizer overhead stream 50 is routed back through the exchanger 6, where it is partially liquefied and exits as stream 55, then reduced in pressure through valve 53 and enters an upper feed point at the overhead of tower 70. That is, stream 52 is routed above one or more equilibrium stages, with the expander outlet stream 16 entering below the mass transfer stage(s) for the tower 70 overhead vapor stream 54 to meet the processing requirement of a benzene concentration specification of less than 1 ppmv. Consequently, tower 70 receives stream 52 and stream 16 as feeds.

Notably, stream 64 to LNG contains only 0.0024 ppm benzene versus a typical specification of less than 1.0 ppm. It is nearly "nothing" and non-detectable. This extremely good performance provides a very large margin from going "off-spec". As a result, the process can be expected to operate at a higher pressure and temperature in the tower and still meet required vapor product benzene purity.

Power requirement for the residue gas compressor 62 is estimated to be 7300 HP, power for the debutanizer overhead compressor is estimated as 973 HP. On a per million standard cubic feet of gas per day (MMscfd) inlet gas processed basis, (7300+973) HP/728.5 MMscfd equals 11.36 HP/MMscfd. Refrigeration compression may also be required for the debutanizer overhead condenser. Alternatively, the debutanizer overhead condensing duty could be incorporated into the main heat exchanger 6. Another alternative is to recycle a portion of the liquid produced when the compressed debutanizer overhead stream is cooled to act as reflux for the absorber tower.

Figure 2:
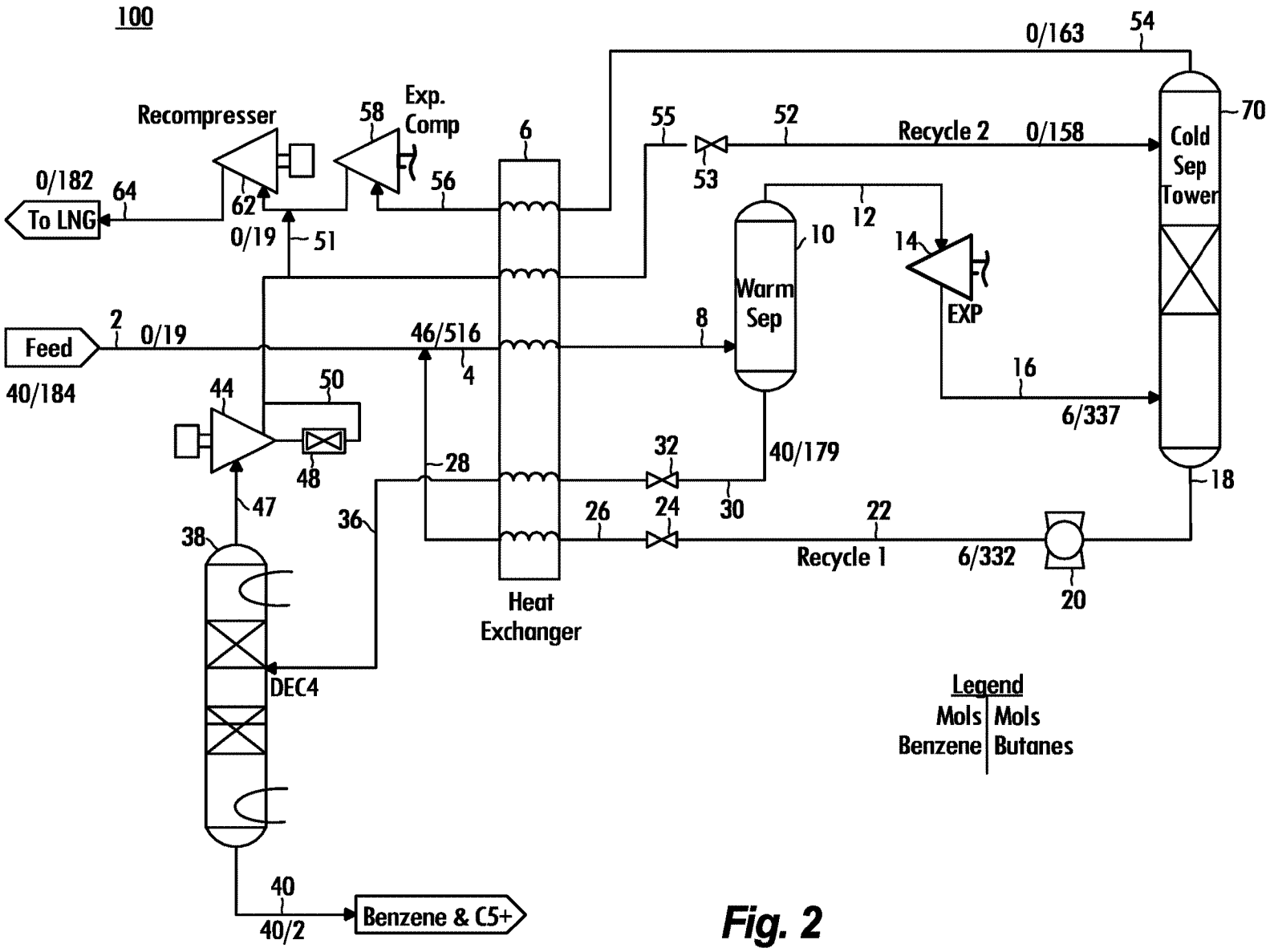
FIG. 2 is a schematic view of illustrating exemplary concentrations of benzene and mixed butanes at various points in the gas stream during the process of FIG. 1.

FIG. 2 is a schematic view of exemplary concentrations of benzene and mixed butanes in the gas stream during the process of removing high freeze point hydrocarbons using system 100 described above in FIG. 1. As shown, molar rate of benzene is provided for key points of the process to help with understanding of the system 100. Molar rate of butane is also provided, as an indicator of the amount of dilution provided to prevent benzene freezing. Table 2 below shows the corresponding concentration of benzene and butanes at various points of FIG. 2.

Table 2 below shows how the recycles in the process decrease the concentration of benzene in non-freezing liquids (which include the C4s), and also shows how all of the inlet benzene is removed in the separator 10. Benzene in the separator 10 overhead is only the benzene that is recycled back to the cold separator 10 from the tower 70. Reheating the absorber tower bottoms stream 18 and mixing it back in to the feed gas 2 causes nearly all of the freeze components in the feed gas 2 to be contained in the separation vessel liquid outlet stream of the separator 10. The second loop, indicated as recycle 2, contains almost no measurable benzene at all.

TABLE 2

Benzene and mixed butanes concentrations at representative points in the process shown in FIG. 2.

| Stream | Mols benzene & mols mixed butanes |
|---|---|
| Inlet gas (2) | 40 & 184 |
| Inlet gas plus liquid recycle loop (4) | 46 & 516 (This represents a large dilution of the benzene with butanes) |

TABLE 2-continued

Benzene and mixed butanes concentrations at representative points in the process shown in FIG. 2.

| Stream | Mols benzene & mols mixed butanes |
|---|---|
| Cold separator bottoms (30) | 40 & 179 (note: all inlet benzene removed here) |
| Vapor feed to absorber (16) | 6 & 337 (the 6 mols of benzene that recycle in the system are diluted with butanes so the benzene doesn't freeze in this cold part of the plant) |
| Reflux from debutanizer overhead (52) | 0 & 158 (no benzene in reflux - purifies tower overhead, and drives all recycled C4s out bottom) |
| Absorber tower overhead to LNG (54) | 0 & 163 (note: almost no benzene) |
| 51 - Unused debutanizer overhead portion | 0 & 19 (DeC4 overhead excess not required for reflux) |
| 64 - Purified gas to LNG | 0 & 182 (note only 0.0024 ppm benzene concentration in gas to to LNG, but nearly all C4s to LNG |
| 40 - Debutanizer bottoms stream | 40 & 2 (all inlet gas benzene, and 5% of inlet C4s) |

Figure 3:
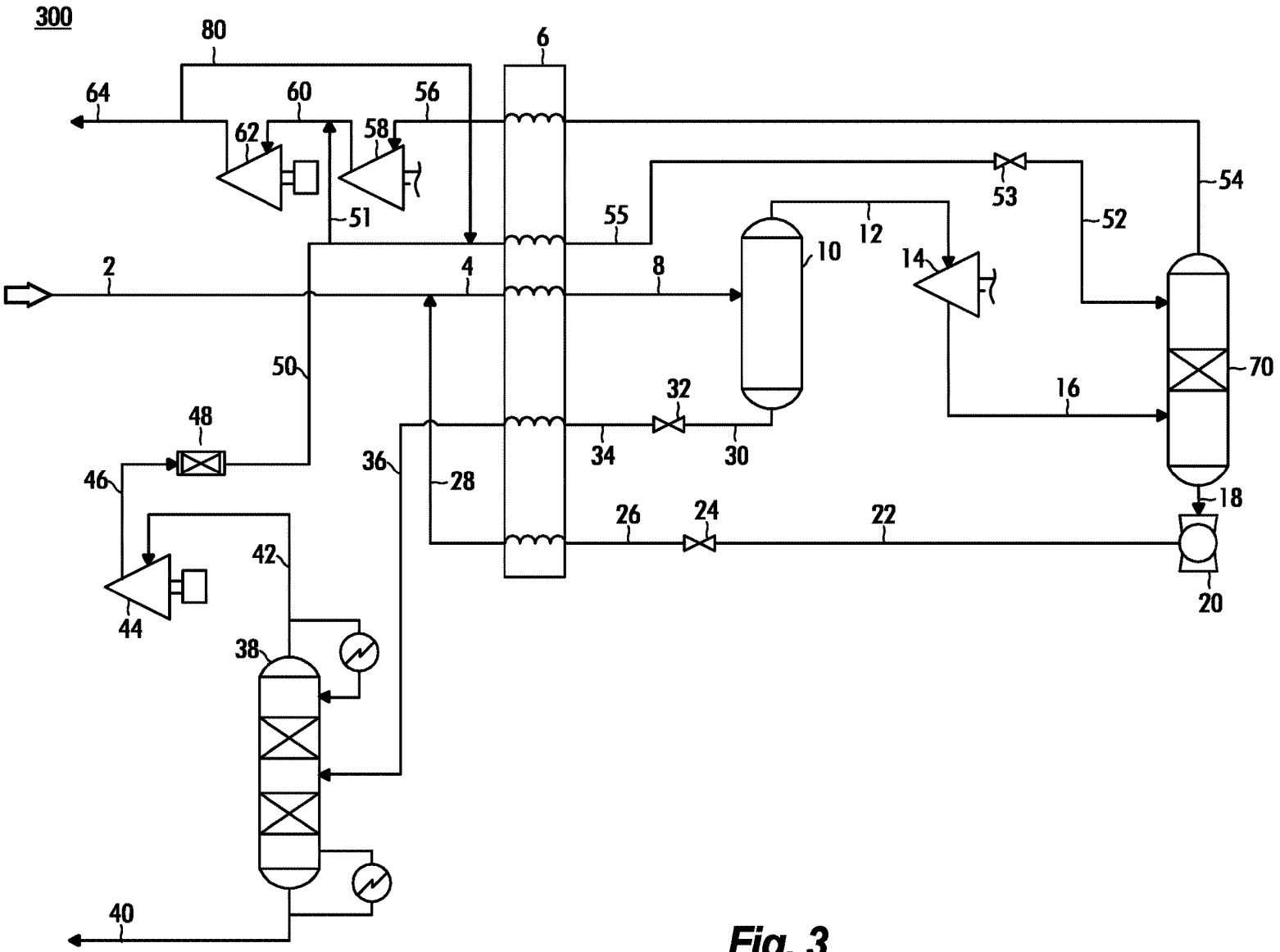
FIG. 3 is a schematic view of an exemplary system and process for removing high freeze point hydrocarbons from a mixed hydrocarbon gas stream according to a second embodiment herein.

FIG. 3 is a schematic view of an exemplary system 300 for removing high freeze point hydrocarbons from a mixed hydrocarbon gas stream, according to a second embodiment herein. System 300 is similar to system 100 described above in the context of FIG. 1. System 300 includes an additional step in which a portion (stream 80) of the compressed residue gas stream exiting residue compressor 62 is taken for further processing. Stream 80 is mixed with the compressed debutanizer overhead stream 50, this combined stream is cooled in exchanger 6, and the combined, partially condensed stream is used as an overhead feed to the absorber tower 70.

Feed gas composition and conditions are the same as those of the system 100 in FIG. 1, and the inlet pressure and the pressure at tower 70 are unchanged. In this case, for example, 1100 mol/hr of DeC4 overhead are recycled, and 7800 mols/hr of residue gas are recycled. The result is a benzene concentration of less than 0.01 ppm benzene and less than 0.002% C5+ in the treated gas to the LNG plant. In this process, the minimum approach to benzene freezing is greater than 10° C. at any point in the process. Combined residue compression and debutanizer overhead compression is about 12.5 HP/MMscfd of inlet gas.

An important benefit of the arrangement in this embodiment is that it indicates an increase in the rate of excess C4– solvent that is routed to the LNG plant in stream 51. The additional reflux rate provided by recycle stream 80 causes this higher rate of excess C4-, because more surplus solvent is available. This indicates that C2 and C3 recovery for use as refrigerant make-up for the LNG plant refrigeration systems is possible. Recovery of any C2 and C3 components for refrigeration make-up would be accomplished by adding more distillation towers beyond the single DeC4 indicated as debutanizer 38 in system 300 of FIG. 3. The estimated requirement for C2 and C3 LNG plant refrigerant make-up is available for recovery by installation of additional distillation towers to process the debutanizer overhead, or by installing additional towers upstream of the debutanizer.

Figure 4:
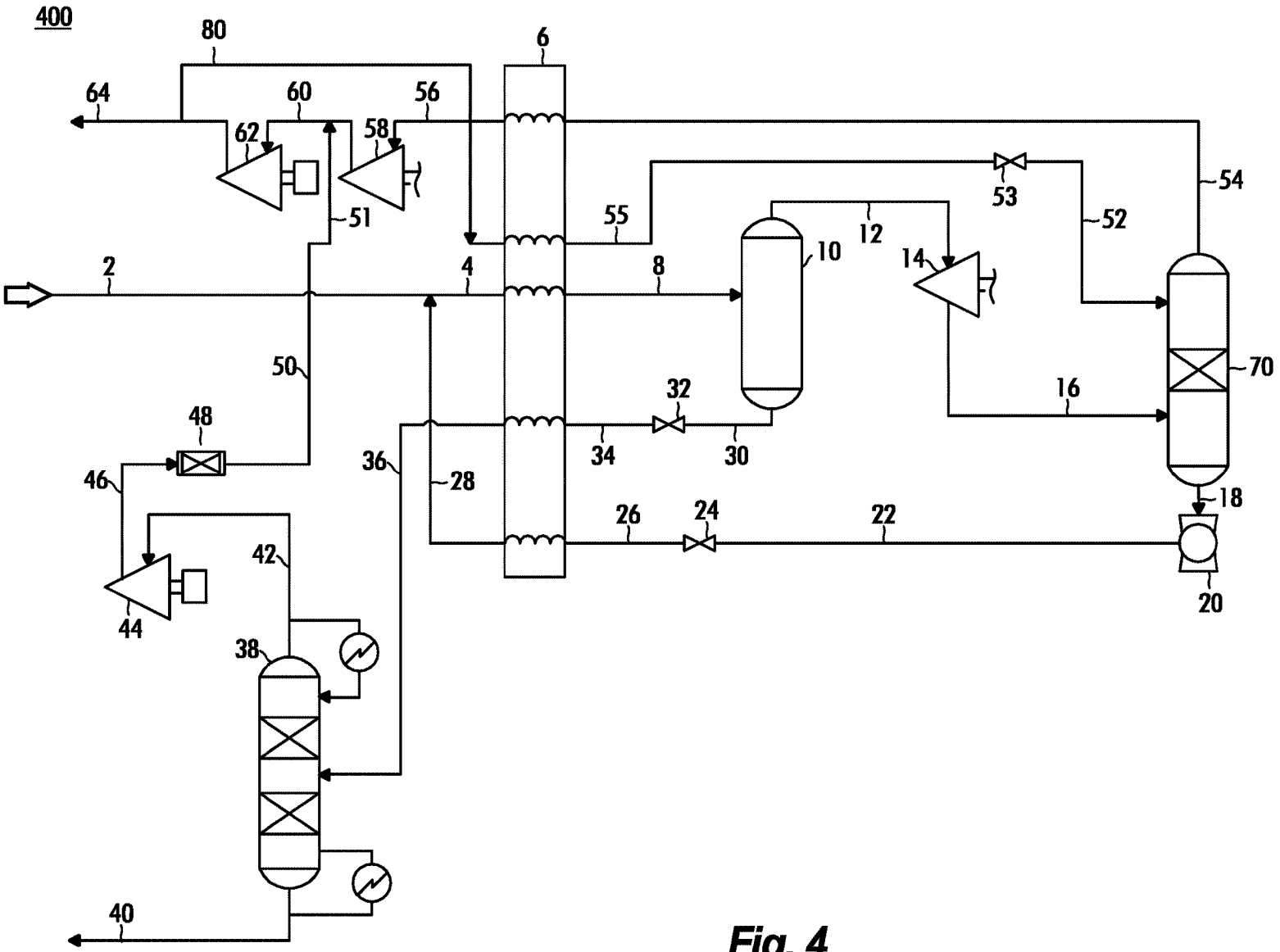
FIG. 4 is a schematic view of an exemplary system and process for removing high freeze point hydrocarbons from a mixed hydrocarbon gas stream according to a third embodiment herein.

FIG. 4 is a schematic view of an exemplary system 400 for removing high freeze point hydrocarbons from a mixed hydrocarbon gas stream, according to a third embodiment herein. This exemplary embodiment indicates some of the difficulties of operation if the debutanizer overhead stream 50 is not recycled. Without this recycle, there is the possibility of freezing, as using only residue gas recycle stream 80 for reflux to the expander outlet tower may be inadequate.

A portion of the compressed residue gas stream 64 is drawn out as stream 80, this stream is then cooled in exchanger 6, the pressure of the cooled stream is reduced, and the cooled stream is routed as the overhead stream to the absorber tower 70. Feed gas composition and conditions are the same as previous embodiments shown and described in FIGS. 1 and 3, operating pressures are unchanged and liquid recycle remains at 1100 mol/hr. The debutanizer overhead stream 50 is sent entirely to the LNG via line 51 in FIG. 4. In this case, the feed gas 2 is combined with recycle 28 to become stream 4 and is subject to freezing of 1° C. to 2° C. as it is cooled in exchanger 6. There is also a potential for freezing in the initial cooling in expander 14. The treated gas has a benzene content of 0.56 ppm and C5+ content of 0.0056%, meeting LNG feed requirements. This arrangement may be feasible with a feed gas containing less benzene or more propane and butane. However, operation of the tower 70 may also more difficult due to significantly lower liquid flow. HP/MMscfd is about 12.75.

Figure 5:
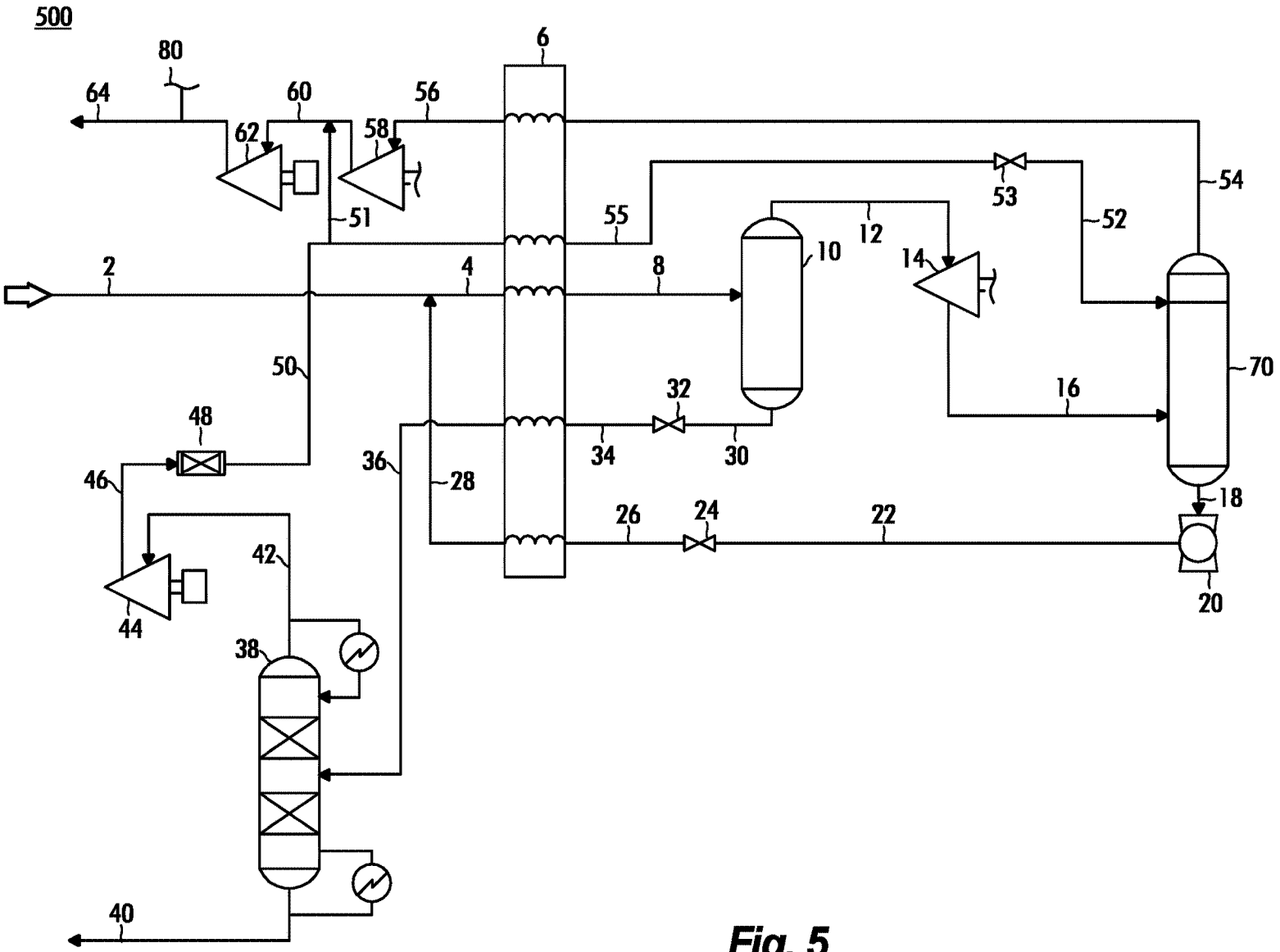
FIG. 5 is a schematic view of an exemplary system and process for removing high freeze point hydrocarbons from a mixed hydrocarbon gas stream according to a fourth embodiment herein.

FIG. 5 is a schematic view of an exemplary system 500 for removing high freeze point hydrocarbons from a mixed hydrocarbon gas stream according to a fourth embodiment herein. In this embodiment, an overhead liquid feed to the tower 70 is introduced as a spray, which may be advantageous for simplicity or as a retrofit to an existing facility.

At least one equilibrium stage is used in the tower 70 to meet the benzene specification of less than 1 ppmv in the purified gas. If this single stage is not included, the purified gas would contain 2 ppm benzene versus the 0.25 ppm with the single stage. The arrangement shown in FIG. 5 introduces the overhead liquid feed to the tower 70 as a spray and configures the absorber tower 70 without the use of any mass transfer devices such as trays or packing. This creates a single stage of contact. Feed gas composition, rate and operating pressures are unchanged relative to the embodiments previously described above. With this arrangement, the purified gas to the LNG plant contains 0.25 ppm benzene and 0.005% pentane-plus, meeting specifications. Recompression plus DeC4 overhead compressor totals 11.8 HP/MMscfd processed. Liquid rate to the spray is 1100 mols/hr. Note that the purified gas to LNG would not meet the benzene specification if the expander outlet stream is simply mixed with the recompressed DeC4 overhead stream and routed to the expander outlet separator.

Optionally, an existing separator can be retrofitted to spray a stream to add at least a partial stage of mass transfer to an existing expander outlet separator, making it perform as a simple short tower. In this case, by adding the spray and additional heat exchanger(s), a simple version of the present embodiment can be implemented to an existing facility.

Figure 6:
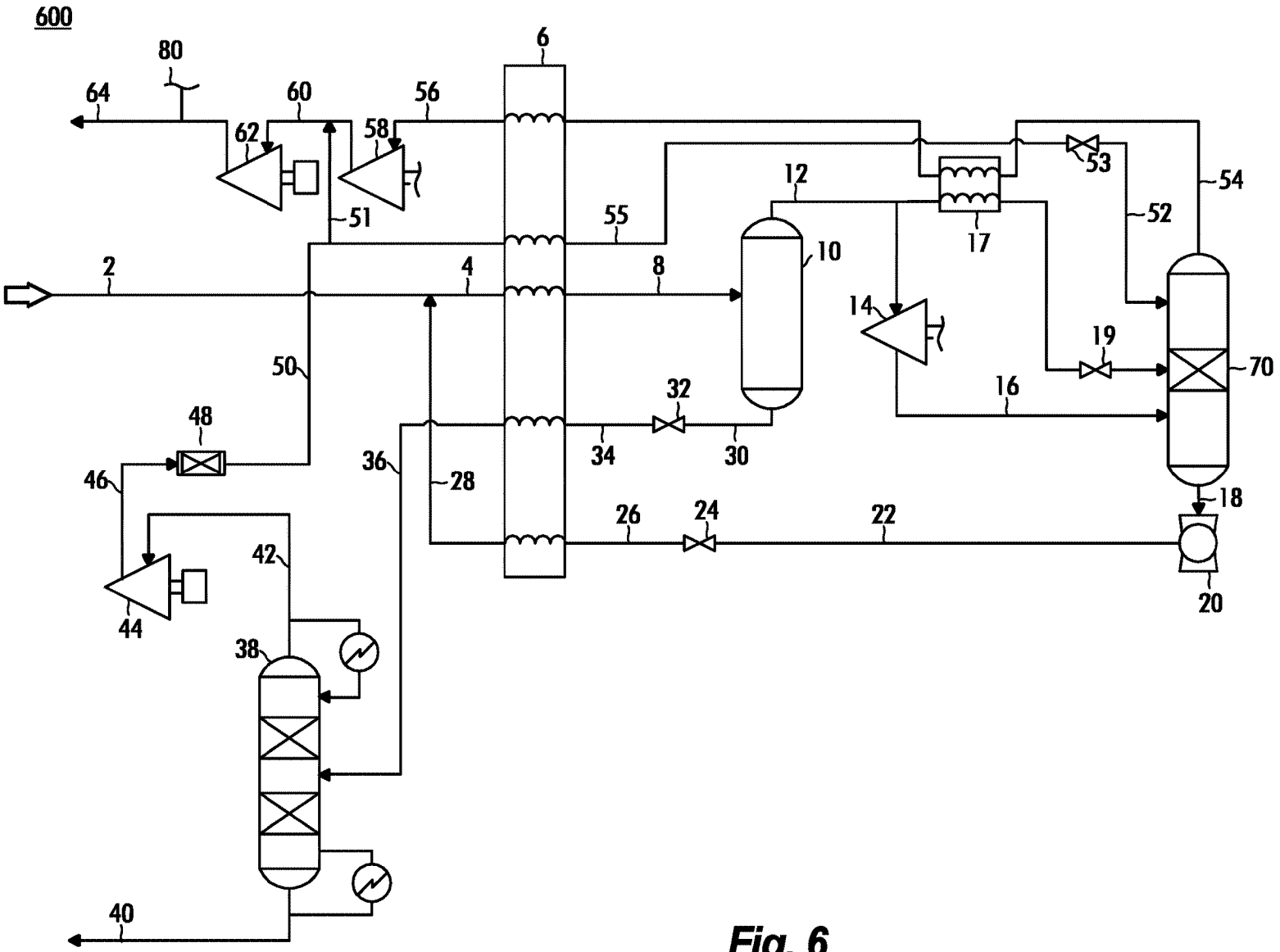
FIG. 6 is a schematic view of an exemplary system and process for removing high freeze point hydrocarbons from a mixed hydrocarbon gas stream according to a fifth embodiment herein.

FIG. 6 is a schematic view of an exemplary system 600 for removing high freeze point hydrocarbons from a mixed hydrocarbon gas stream, according to a fifth embodiment herein. The reflux arrangement shown in FIG. 6 can produce more C2 and C3 for LNG refrigerant make-up than conventional systems or certain embodiments previously described herein.

As shown in FIG. 6, a portion of stream 12 is taken and routed through a heat exchanger 17 and partially liquefied using the tower overhead gas stream 54 for cooling, and then routing the cooled portion of stream 12 through valve 19 to a side inlet of the absorber tower 70. The DeC4 overhead to overhead tower feed is 1100 mols/hr, as it was in other embodiments described above. The new side feed is 7800 mols/hr (the same rate as the residue reflux in FIG. 1). Inlet gas rate and composition is the same as the prior embodiments. Recompression plus DeC4 overhead compressor totals 12.1 HP/MMscfd processed. Gas to the LNG facility contained less than 0.0003 ppm benzene and less than 0.0002% C5+. Moreover, keeping the two streams, 52 and 16, that were combined to form the reflux separate and with separate feed points to the tower 70 results in improved benzene recovery.

Figure 7:
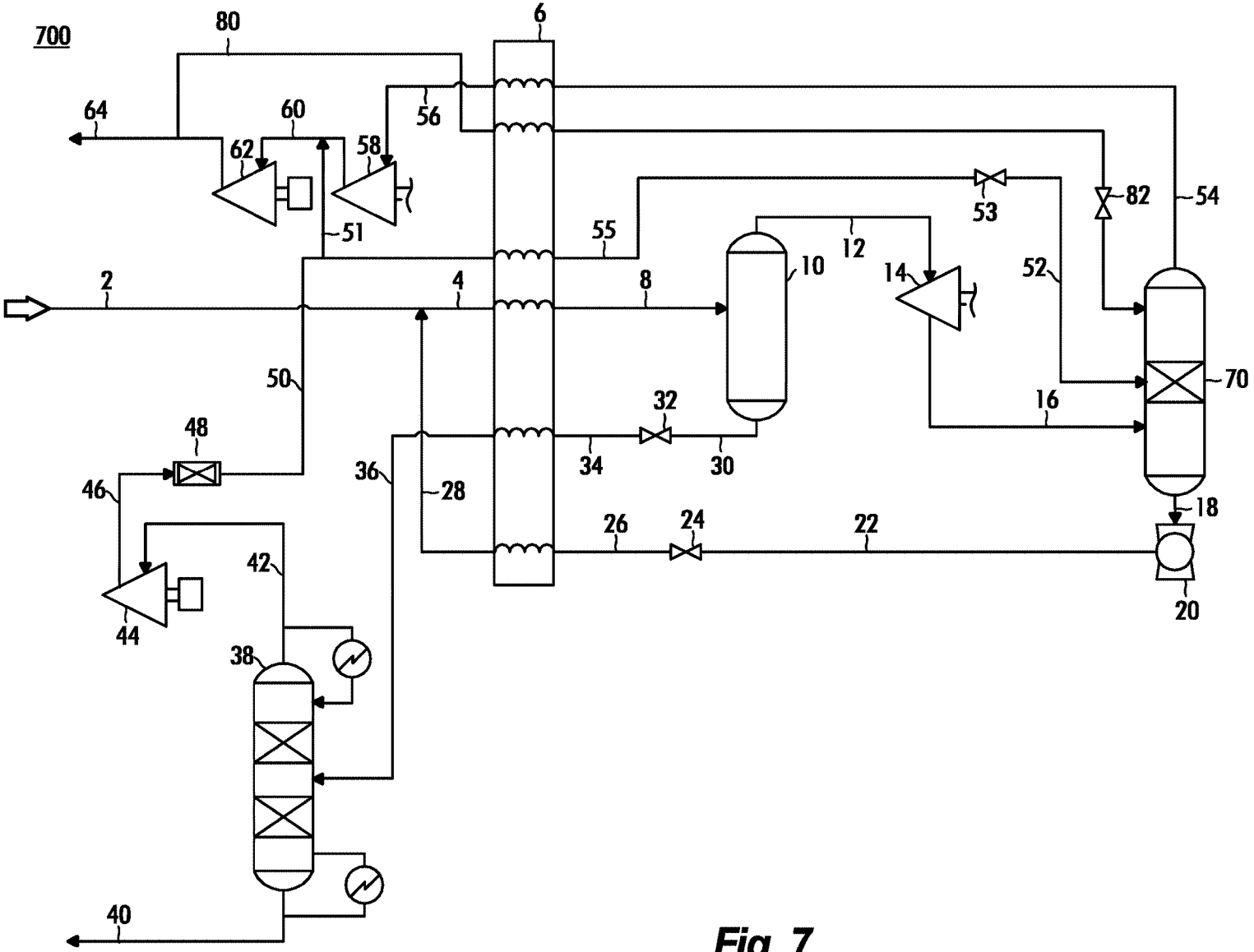
FIG. 7 is a schematic view of an exemplary system and process for removing high freeze point hydrocarbons from a mixed hydrocarbon gas stream according to a sixth embodiment herein.

FIG. 7 is a schematic view of an exemplary system 700 for removing high freeze point hydrocarbons from a mixed hydrocarbon gas stream according to a sixth embodiment herein. The embodiment shown in FIG. 7 provides multiple refluxes which increases purity of the residue gas stream. A portion of the residue gas is sent back as stream 80, cooled in heat exchanger 6 and through a valve 82 before entering tower 70 at an upper feed point. It is to be noted that this step may be performed in a separate exchanger in other embodiments. The reflux stream 52 is used as an intermediate stream entering tower 70 at a side inlet. Use of the residue gas as a overhead reflux stream and the DeC4 overhead as an intermediate stream creates a very pure product stream 64 along with a large amount of C2 and C3 that can be fractionated for refrigerant make-up. This arrangement recovers much more propane and ethane in tower 70 than is achieved in the embodiment shown FIG. 1. This HP/MMscfd is 13.8. Closest temperature approach to freezing is 5.5° C. Use of the residue reflux as a separate stream creates very high recovery of the freeze components, and higher than typical recovery of the C2 and C3. However, the tower loading is low in the overhead section where only residue reflux is present. While a higher reflux rate to achieve higher liquid loading would increase horsepower, this type of arrangement may be preferable in some circumstances depending on application.

Figure 8:
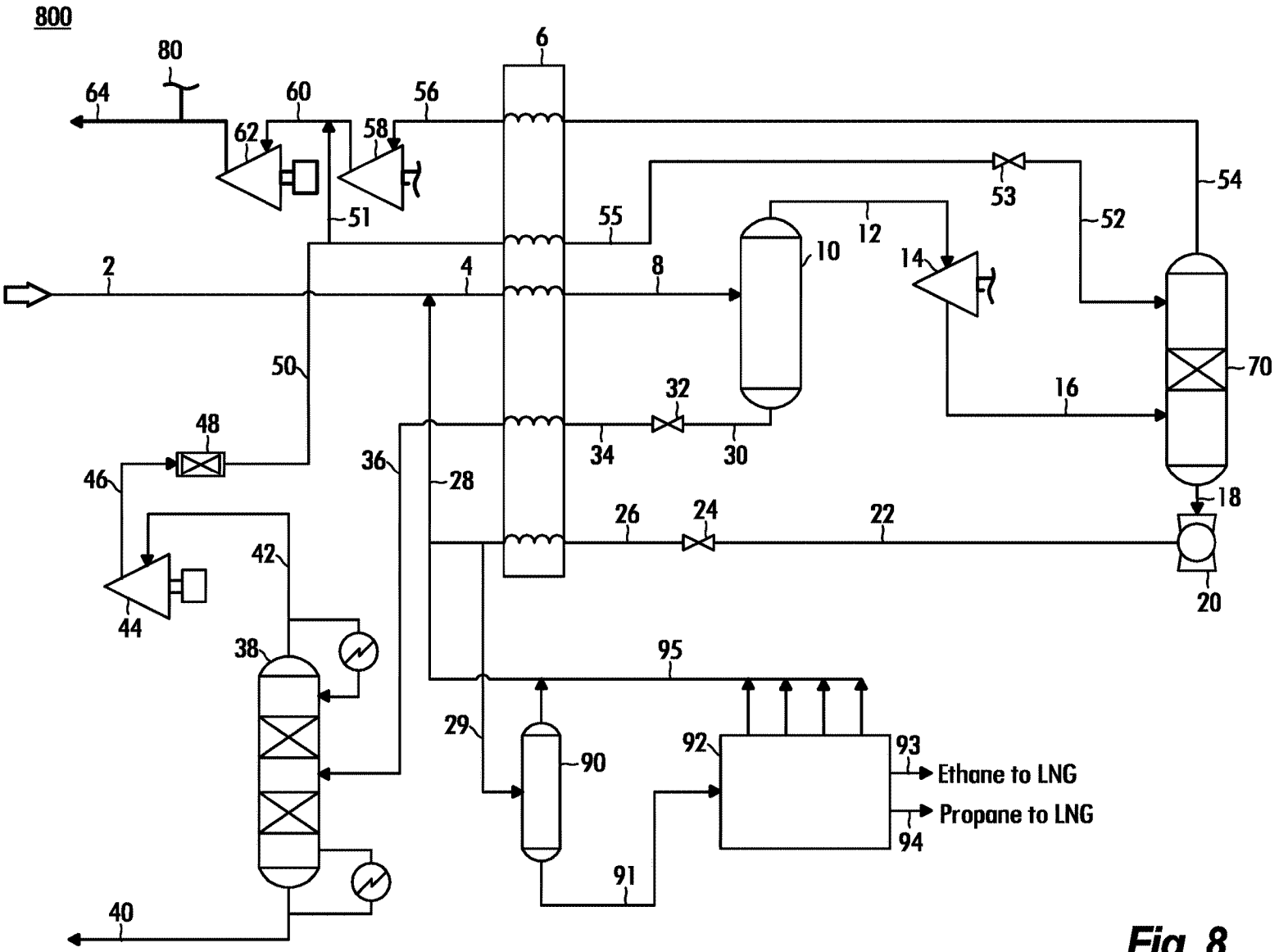
FIG. 8 is a schematic view of an exemplary system and process for removing high freeze point hydrocarbons from a mixed hydrocarbon gas stream according to a seventh embodiment herein.

FIG. 8 is a schematic view of an exemplary system 800 for removing high freeze point hydrocarbons from a mixed hydrocarbon gas stream, according to a seventh embodiment herein. In this embodiment, additional towers are used. As shown, a portion of stream 28 is sent as stream 29 to a vapor/liquid separator 90 and separated liquid exits as stream 91. Stream 91 enters one or more additional towers indicated in area 92, which may include a demethanizer, a deethanizer, a depropanizer and/or a debutanizer. The deethanizer can be used to provide refrigerant-grade ethane to an LNG plant as stream 93, and the depropanizer can be used to provide refrigerant grade propane to an LNG plant as stream 94. In some embodiments, a portion of the deethanizer and/or depropanizer overhead streams, shown as stream 95, can be routed to provide refrigerant make-up to a liquefaction plant, another refrigerant service, or for sale. Methane, ethane propane and butane not required for other services may be routed back as stream 95, to join the bypass portion of stream 28 and be routed to join stream 2.

In certain embodiments, a pressure reduction valve can be substituted for the expander 14 in any embodiment described herein. In certain embodiments, a compressor can be used to increase the pressure of gas entering the plant, allowing for a new efficient design.

In various embodiments, the pressure of the absorber tower overhead is above 400 psia, for example 675 psia, reducing the absorber tower pressure causes higher recovery of C2 and C3, and a higher excess of debutanizer overhead in all cases. Lowering the absorber tower pressure will increase the amount of C2 and C3 available for refrigerant system make-up, if desired. Note that a portion of the residue gas can be cooled and partially condensed and reduced in pressure, and then be used for heat exchange in the overhead of the absorber tower, rather than as reflux.

Tables 3 and 6 below are exemplary overall material balance plus recycle streams for the embodiment described above in the context of FIG. 1. Table 3 provides stream information for system 100 with 900 psia feed, 500 ppm benzene in the feed, and 675 psia tower 70; also referenced as the "base case."

TABLE 3

Material Balance Streams

| | STREAM NAME | | | | | |
|---|---|---|---|---|---|---|
| | Feed Gas | Feed + Recycle | Cold Separator vapor | Expander outlet | Absorber Tower Bottoms | Cold Separator Liquid |
| PFD STREAM NO. | 2 | 4 | 12 | 16 | 18 | 30 |
| PRESSURE (psia) | 900.0 | | | | | |
| MOLAR FLOW RATE (lbmol/hr) | 79,957 | | | | | |
| MASS FLOW RATE (lb/hr) | 1,334,355 | | | | | |
| COMPOSITION (lbmol/hr) | | | | | | |
| Nitrogen | 159.914 | | | | | |
| Methane | 77,622.256 | | | | | |
| Ethane | 1,447.222 | | | | | |
| Propane | 383.794 | | | | | |
| i-Butane | 87.953 | 231.831 | 161.980 | 161.980 | 143.881 | 69.852 |
| n-Butane | 95.948 | 284 879 | 175.529 | 175 529 | 188.931 | 109.350 |
| Pentane+ | 119.936 | 164.965 | 43.844 | 43 844 | 45.030 | 121.122 |
| Benzene | 39.979 | 46.431 | 6.4152 | 0.452 | 6.452 | 39.979 |
| VAPOR | | | | | | |
| MOLAR FLOW RATE (lbmol/hr) | 79,957.0 | | | | | |
| MASS FLOW RATE (lb/hr) | 1,334,355 | | | | | |
| STD VOL FLOW (MMscfd) | 728.17 | | | | | |
| DENSITY (lb/ft^3) | 3.18 | 3.29 | 6.18 | 4.84 | — | — |
| VISCOSITY (cP) | 0 0125 | 0.0125 | 0.0122 | 0.0106 | — | — |

TABLE 3-continued

| Material Balance Streams | | | | | | |
|---|---|---|---|---|---|---|
| LIGHT LIQUID | | | | | | |
| MOLAR FLOW RATE (lbmol/hr) | — | | | | | |
| MASS FLOW RATE (lb/hr) | — | | | | | |
| DENSITY (lb/ft^3) | — | — | 30.98 | 26.25 | 25.97 | 31.02 |
| VISCOSITY (cP) | — | — | 0.1321 | 0.0775 | 0.0752 | 0.1328 |
| SURFACE TENSION (Dyne/cm) | — | — | 8.00 | 5.52 | 5.40 | 8.02 |

| | STREAM NAME | | | | |
|---|---|---|---|---|---|
| | C5+ and Benzene | DeC4 Overhead to Compression | DeC4 Overhead to Absorber Tower | Absorber Tower Overhead | Compressed Gas to LNG |
| PFD STREAM NO. | 40 | 51 | 52 | 54 | 64 |
| PRESSURE (psia) | | | | 675.0 | 907.0 |
| MOLAR FLOW RATE (lbmol/hr) | | | | 79,663.95 | 79,796.48 |
| MASS FLOW RATE (lb/hr) | | | | 1,317,465 | 1,320,877 |
| COMPOSITION (lbmol/hr) | | | | | |
| Nitrogen | | | | 159.854 | 159.914 |
| Methane | | | | 77,530.88 | 77,622,257 |
| Ethane | | | | 1,437.052 | 1,447.224 |
| Propane | | | | 372.191 | 383.784 |
| i-Butane | 0.069 | 7.504 | 62.279 | 80.378 | 87.881 |
| n-Butane | 1.609 | 11.585 | 96.157 | 82.754 | 94.339 |
| Pentane+ | 118.851 | 0 244 | 2.026 | 0.840 | 1.084 |
| Benzene | 39.979 | 0 000 | 0.000 | 0.000 | 0.000 |
| VAPOR | | | | | |
| MOLAR FLOW RATE (lbmol/hr) | | | | 79,664.0 | 79,796.5 |
| MASS FLOW RATE (lb/hr) | | | | 1,317,465 | 1,320,877 |
| STD VOL FLOW (MMscfd) | | | | 725.50 | 726.71 |
| DENSITY (lb/ft^3) | 3.04 | 5.25 | 4.67 | 4.77 | 2.93 |
| VISCOSITY (cP) | 0.0116 | 0.0146 | 0.0105 | 0.0105 | 0.0129 |
| LIGHT LIQUID | | | | | |
| MOLAR FLOW RATE (lbmol/hr) | | | | — | — |
| MASS FLOW RATE (lb/hr) | | | | — | — |
| DENSITY (lb/ft^3) | 31.47 | 25.03 | 26.81 | — | — |
| VISCOSITY (cP) | 0.0861 | 0.0706 | 0.0819 | — | — |
| SURFACE TENSION (Dyne/cm) | 4.29 | 4.84 | 5.94 | — | — |

Good physical properties ensure ability to separate vapor and liquid. The absorber tower 70 in one or more of the embodiments described above may use four theoretical stages. Table 4 below shows exemplary vapor and liquid properties in the absorber tower 70 using four stages.

TABLE 4

| Vapor and liquid properties in the absorber tower | | | |
|---|---|---|---|
| | Vapor Density ($lb/ft^3$) | Liquid Density ($lb/ft^3$) | Liquid Surface Tension ($dynes/cm^2$) |
| First Separator vapor | 6.2 | | |
| First Separator liquid | | 31 | 8 |
| Absorber tower overhead | 4.8 | | |
| Stage 2 | 4.8 | 26 | 5.3 |
| Stage 3 | 4.8 | 25 | 5.2 |

TABLE 4-continued

| Vapor and liquid properties in the absorber tower | | | |
|---|---|---|---|
| | Vapor Density ($lb/ft^3$) | Liquid Density ($lb/ft^3$) | Liquid Surface Tension ($dynes/cm^2$) |
| Stage 4 | 4.8 | 25 | 5.2 |
| Bottoms | | 26 | 5.4 |

This data indicates very good conditions for separation. This is possible due to the multiple recycle rates, compositions, and especially routings of the embodiments described herein. These properties are surprisingly good for operation of light hydrocarbons at 675 psia.

TABLE 5

| Temperature approach to benzene freeze in the process | |
|---|---|
| Key streams | Approach to Freezing, degree C. |
| 4 to 8 - cooling in exchanger | 9 (9 to 44 range throughout exchanger) |
| 30 - cold separator liquid | 10 |
| 34 - Cold separation downstream of LCV | 9 |
| 12 to 16 - Cooling through expander | 10 (10 to 40 range throughout expander) |
| 16 - expander outlet | 40 |
| 70 - tower (all stages) | 90 (at the lowest temperature approach stage) |

As shown above in Table 5, the systems in the embodiments described above are 40° C. and 90° C. away from freezing in the coldest section in the plant, the expander outlet and the tower, due to removal of benzene upstream combined with the high rate of dilution by butanes and other components.

Table 6 below provides material balance stream information for the "high pressure case" of 1000 psia inlet and 800 psia absorber tower, 400 ppm benzene in the feed. Minimum pressure in the main process loop is 800 psia. The minimum liquid surface temperature is 2.86 Dyne/cm. Vapor and liquid densities are still acceptable, although they are approaching reasonable limits. This case presents the feasibility of operating at very high pressure. The process flow diagram is identical to the earlier example of FIG. 1. In this case, the horsepower for residue gas recompression to 1000 psia plus DeC4 overhead compression is 7573 HP, or 10.4 HP/MMscfd. Minimum approach to freezing of benzene at any point in the process is 5° C.

TABLE 6

Material Balance Streams

| | STREAM NAME | | | | | | |
|---|---|---|---|---|---|---|---|
| | Feed Gas | Feed + Recycle | Cold Separator Vapor | Expander Outlet | Absorber Tower Bottoms | Cold Separator Liquid | C5+ and Benzene |
| PFD STREAM NO. | 2 | 4 | 12 | 16 | 18 | 30 | 40 |
| PRESSURE (Psia) | 1,000.0 | | | | | | |
| MOLAR FLOW RATE (lbmol/hr) | 79,957 | | | | | | |
| MASS FLOW RATE (lb/hr) | 1,350,506. | | | | | | |
| COMPOSITION (lbmol/hr) | | | | | | | |
| Nitrogen | 214.072 | | | | | | |
| Methane | 76852.954 | | | | | | |
| Ethane | 1937 353 | | | | | | |
| Propane | 513.773 | | | | | | |
| i-Butane | 117.740 | 253.698 | 190.443 | 190.443 | 135.951 | 63.255 | 0.033 |
| n-Butane | 128.443 | 295.660 | 204.811 | 204.811 | 167.214 | 90 849 | 0.760 |
| Pentane+ | 160.554 | 257.677 | 101.363 | 101.363 | 97.123 | 156.314 | 156.288 |
| Benzene | 32.111 | 44.178 | 12.129 | 12.129 | 12.067 | 32.050 | 32.050 |
| VAPOR | | | | | | | |
| MOLAR FLOW RATE (lbmol/hr) | 79,957.0 | | | | | | |
| MASS FLOW RATE (lb/hr) | 1,350,506 | | | | | | |
| STD VOL. FLOW (MMscfd) | 728.25 | | | | | | |
| DENSITY (lb/ft^3) | 3.66 | 3.79 | 8.66 | 7.01 | | | 3.09 |
| VISCOSITY (cP) | 0.0128 | 0.0128 | 0.0144 | 0.0124 | | | 0.0115 |
| LIGHT LIQUID | | | | | | | |
| MOLAR FLOW RATE (lbmol/hr) | — | — | | | | | |
| MASS FLOW RATE (lb/hr) | — | — | | | | | |
| DENSITY (lb/ft^3) | — | — | 27.14 | 21.18 | 20.88 | 27.20 | 30.63 |
| VISCOSITY (cP) | — | — | 0 0929 | 0.0488 | 0.0473 | 0.0935 | 0.0843 |
| SURFACE TENSION (Dyne/cm) | — | — | 5.73 | 3.25 | 3.15 | 5.75 | 3.85 |

| | STREAM NAME | | | |
|---|---|---|---|---|
| | DeC4 overhead to Compression | DeC4 Overhead to Absorber Tower | Absorber Tower Overhead | Compressed Gas to LNG |
| PFD STREAM NO. | 51 | 52 | 54 | 64 |
| PRESSURE (Psia) | | | 800.0 | 1,007.0 |
| MOLAR FLOW RATE (lbmol/hr) | | | 79,567.36 | 79,768.20 |
| MASS FLOW RATE (lb/hr) | | | 1,329,961 | 1,334,436 |
| COMPOSITION (lbmol/hr) | | | | |
| Nitrogen | | | 213.898 | 214.072 |
| Methane | | | 76697.698 | 76851.211 |
| Ethane | | | 1920.872 | 1937.388 |
| Propane | | | 500.558 | 513.802 |
| i-Butane | 6.346 | 56 876 | 111.368 | 117.714 |
| n-Butane | 9.043 | 81.042 | 118.639 | 127.682 |
| Pentane+ | 0.003 | 0.023 | 4.263 | 4.266 |
| Benzene | 0.000 | 0.000 | 0.062 | 0.062 |

TABLE 6-continued

| Material Balance Streams | | | | |
|---|---|---|---|---|
| VAPOR | | | | |
| MOLAR FLOW RATE (lbmol/hr) | | | 79,567.4 | 79,768.2 |
| MASS FLOW RATE (lb/hr) | | | 1,329,961 | 1,334,436 |
| STD VOL. FLOW (MMscfd) | | | 724.70 | 726.53 |
| DENSITY (lb/ft^3) | 4 75 | 6.33 | 6.94 | 3.38 |
| VISCOSITY (cP) | 0.0145 | 0.0119 | 0 0123 | 0.0131 |
| LIGHT LIQUID | | | | |
| MOLAR FLOW RATE (lbmol/hr) | | | — | — |
| MASS FLOW RATE (lb/hr) | | | — | — |
| DENSITY (lb/ft^3) | — | 22.56 | — | — |
| VISCOSITY (cP) | — | 0.0557 | — | — |
| SURFACE TENSION (Dyne/cm) | — | 4.05 | — | — |

For various embodiments herein, the physical properties are very good for separation in the separator and in the tower, and there is excess liquid in the new overlapping recycle which is drawn off and sent to the LNG plant. As such, embodiments herein may operate at even higher pressures with associated further reduction in recompression requirements. As pressure is increased, the excess liquid rate will be reduced due to both changes in volatility and because higher liquid rate is desired to maintain recovery with less pressure drop available.

For example, operation with 900 psia feed gas and with pressure at the overhead of the absorber tower 70 increased from 675 psia to 700 psia uses all of the available excess solvent, and the cold separator temperature is reduced 2° F. Closest approach to freezing becomes 5.2° C. in the inlet heat exchange. Physical properties for separation are still good, with the tightest point being in the overhead of the tower 70 with a surface tension of 5.4 dynes/cm' and 5.3 vapor and 26 liquid density, in lbs/ft$^3$. Inlet gas still contains 500 ppm in this example, while solvent recirculation rate remains unchanged.

As another example, operation at 725 psia is also possible, but with 400 ppm benzene in the feed gas, rather than 500 ppm. Physical properties are still acceptable for separation. Closest approach to freezing becomes 5° C. in the inlet heat exchange. Still further, operation at 750 psia is also possible, with 300 ppm benzene in the feed gas.

Feed gas pressure is maintained at 900 psia in the above cases wherein the absorber tower operating pressure increased. As the absorber tower pressure is increased and the feed gas and treated gas pressure are held constant at 900 psia, the power requirement for recompression and debutanizer overhead compression decreases noticeably. With the absorber tower overhead pressure in these cases changing from 675 psia to 750 psia, the total compression horsepower per MMscfd inlet gas is reduced from 11.36 to 8.04 HP/MMscfd.

Reducing the pressure reduction required for separation can have a large effect on plant compression power requirements. It is very important to note that favorable physical properties for mass transfer and separation at these higher pressures are a result of the large amount of butane and other components that are recycled, creating richer streams of higher molecular weight with better physical properties for separation, and at the same time providing the dilution of benzene in the liquid phase thereby preventing freezing. As shown above in Table 5 above, the tower 70, the coldest piece of equipment in the design, is the farthest away from freezing.

Table 7 below summarizes physical property changes between two illustrative case studies. The base case is the scenario wherein the system has 900 psia at the inlet and 675 psia at the absorber tower. The high pressure case is the scenario wherein the system has 1000 psia inlet and 800 psia at the absorber tower.

TABLE 7

| Physical property changes between two illustrative case studies | | | | | | | |
|---|---|---|---|---|---|---|---|
| | Absorber Tower K Values for cases | | | | Vapor Density | Liquid Density | Surface Tension |
| Case | C2 | C3 | iC4 | nC4 | (lb/ft$^3$) | (lb/ft$^3$) | (dyne/cm) |
| High Pressure | 0.3342 | 0.1343 | 0.0711 | 0.055 | 6.94 | 19.85 | 2.86 |
| Base Case | 0.2143 | 0.0558 | 0.022 | 0.0149 | 4.77 | 25.69 | 5.3 |

In other embodiments with slightly higher pressure, e.g., 805 psia versus 800 psia tower operation, the product specifications are met and the power requirement reduced even further. However, richer feed gases or higher recycles should be employed to ensure good physical properties.

Prior to adding stages to the absorber tower 70, the product specification for benzene could not be met for the Base case feed. However, using embodiments herein with the DeC4 overhead recycle and the stages added to the absorber tower 70, the specification for benzene was met by very wide margin, as seen above in the High Pressure case. The base case became so robust that the High Pressure case became possible. The relative volatility (K-value) for components in the High Pressure case range from 155% to 369% of the base case. This measure indicates how much more difficult it is to keep the components in the liquid phase and available for absorption of the benzene, rather than being lost to the product gas. Yet the designs of embodiments herein enable recovery of the benzene as required. The physical properties of the vapor and liquid are also less favorable due to the high pressure. However, they are still within industry acceptable limits for allowing good vapor/liquid separation and proper operation of the absorber tower. The recycle arrangements provided the means to retain an adequate amount of butane and lighter liquids with suitable physical properties to operate the absorber tower and recover the benzene and pentane and heavier components.

Accordingly, embodiments herein create a system with two loops which overlap in a unique way to retain and recycle liquid, while purifying the product gas and also improving the physical properties in the coldest section of the plant to enable reliable separation at high pressure, thereby reducing power requirements (for example, by 10%-30%; alternatively, 30-50%; alternatively, 10-50%) while also processing a gas containing much higher concentration of benzene. Embodiments herein can:

remove freeze components at very high pressure;
use only minimal pressure drop;
avoid freezing;
operate with reasonable stream physical properties;
minimize equipment count; and
allow for operation of the LNG facility with a very low reduction in inlet pressure, even if the recompressor is out of service.

This high pressure inlet application uses similar HP/MMscfd than any earlier case, and provides the purified gas at the highest pressure. The ability to process gas at the highest inlet pressure, with the highest minimum operating pressure is the most efficient operation.

The methods and systems of the present disclosure, as described above and shown in the drawings, provide for removal of high freeze point hydrocarbons at higher pressure than conventional systems. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A method of removing high freeze point components from natural gas, comprising:

cooling a feed gas in a heat exchanger, wherein the feed gas comprises 90 to 98 molar % methane, and 100 to 20,000 ppm molar benzene and other C5+ components;
separating the cooled feed gas into a first vapor portion and a first liquid portion;
heating the first liquid portion using the heat exchanger;
separating the heated first liquid portion into a high freeze point components stream comprising benzene and other C5+ components and a non-freezing components stream comprising C1-C4 components;
directing the high freeze point components stream comprising benzene and other C5+ components for removal as a liquid product exit stream;
directing at least a portion of the non-freezing components stream to an absorber tower;
directing the first vapor portion to the absorber tower at a feed point below the at least a portion of the non-freezing components stream;
generating i) an absorber tower overhead vapor stream that is substantially free of high freeze point components, and ii) an absorber tower bottoms stream that includes high freeze point components and non-freezing components;
recycling at least a portion of the absorber tower bottoms stream to the feed gas upstream of the heat exchanger; and
heating the absorber tower overhead vapor stream using the heat exchanger.

2. The method of claim 1, wherein the absorber tower includes one or more mass transfer stages.

3. The method of claim 1, further comprising compressing the heated absorber tower overhead vapor stream using an expander-compressor to produce a compressed gas stream.

4. The method of claim 3, further comprising compressing the compressed gas stream to produce a residue gas stream having a pressure that is greater than a pressure of the compressed gas stream.

5. The method of claim 4, further comprising directing the residue gas stream to a natural gas liquefaction facility.

6. The method of claim 4, wherein separating the heated first liquid portion includes using a distillation column, a distillation tower, or a debutanizer.

7. The method of claim 4, further comprising combining a portion of the residue gas stream with the at least a portion of the non-freezing components stream to form a combined stream, cooling the combined stream in the heat exchanger, and directing the combined stream to the absorber tower.

8. The method of claim 1, further comprising cooling and pressure reducing the at least a portion of the non-freezing components stream upstream of the absorber tower.

9. The method of claim 8, further comprising compressing the at least a portion of the non-freezing components stream prior to cooling and pressure reducing the at least a portion of the non-freezing components stream.

10. The method of claim 1, wherein the at least a portion of the non-freezing components stream is introduced to the absorber tower as a spray.

11. The method of claim 1, further comprising:

directing a first portion of the first vapor portion and the absorber tower overhead vapor stream to a second heat exchanger to partially liquefy the first portion of the first vapor portion;
directing a second portion of the first vapor portion to a pressure reduction device to partially liquefy the second portion of the first vapor portion;
directing the partially liquefied first portion of the first vapor portion to a side inlet of the absorber tower; and
directing the partially liquefied second portion of the first vapor portion to the absorber tower at a feed point below the side inlet.

12. The method of claim 4, further comprising directing a portion of the residue gas stream through the heat exchanger and a valve to the absorber tower.

13. The method of claim 1, further comprising directing a portion of the absorber tower bottoms stream to one or more additional towers selected from demethanizers, deethanizers, depropanizers, and debutanizers.

14. The method of claim 1, wherein an operating pressure of the absorber tower is within one of 400 psia, 250 psia, 225 psia, and 150 psia of a pressure of the feed gas.

15. A system for removing high freeze point components from natural gas, comprising:

a heat exchanger for cooling a feed gas, wherein the feed gas comprises 90 to 98 molar % methane, and 100 to 20,000 ppm molar benzene and other C5+ components;
a separation vessel for separating the feed gas into a first vapor portion and a first liquid portion, wherein the first liquid portion is heated in the heat exchanger;
a second separation vessel for separating the heated first liquid portion into a high freeze point components stream comprising benzene and other C5+ components and a non-freezing components stream comprising C1-C4 components;

an exit line for removing from the system the high freeze point components stream comprising benzene and other C5+ components as a liquid product;

an absorber tower for receiving at least a portion of the non-freezing components stream and the first vapor portion and for generating i) an absorber tower overhead vapor stream that is substantially free of high freeze point components, and ii) an absorber tower bottoms stream that includes high freeze point components and non-freezing components; and a line for directing at least a portion of the absorber tower bottoms stream to the feed gas upstream of the heat exchanger.

16. The system of claim 15, wherein the absorber tower includes one or more mass transfer stages.

17. The system of claim 15, further comprising an expander-compressor to compress the absorber tower overhead vapor stream to produce a compressed gas stream, and a compressor to compress the compressed gas stream to produce a residue gas stream.

18. The system of claim 15, wherein the second separation vessel is a distillation column, a distillation tower, or a debutanizer.

19. The system of claim 17, further comprising a line for directing at least a portion of the residue gas stream to a portion of the non-freezing components stream.

20. The system of claim 15, further comprising one or more additional towers for receiving a portion of the absorber tower bottoms stream, the one or more additional towers selected from, demethanizers, deethanizers, depropanizers, and debutanizers.

* * * * *